US008523137B2

(12) United States Patent
Schwörer

(10) Patent No.: US 8,523,137 B2
(45) Date of Patent: Sep. 3, 2013

(54) SLAB FORMWORK SYSTEM

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 673 days.

(21) Appl. No.: 12/296,095

(22) PCT Filed: Mar. 29, 2007

(86) PCT No.: PCT/EP2007/002825
§ 371 (c)(1),
(2), (4) Date: May 15, 2009

(87) PCT Pub. No.: WO2007/115700
PCT Pub. Date: Oct. 18, 2007

(65) Prior Publication Data

US 2009/0250589 A1 Oct. 8, 2009

(30) Foreign Application Priority Data

Apr. 3, 2006 (DE) ..... 10 2006 015 348

(51) Int. Cl.
*E04G 11/00* (2006.01)

(52) U.S. Cl.
USPC ..... 249/18

(58) Field of Classification Search
USPC ..... 249/18–20; 108/153.1–158.13; 248/188, 188.1
See application file for complete search history.

(56) References Cited

U.S. PATENT DOCUMENTS

| | | | | |
|---|---|---|---|---|
| 5,614,122 | A * | 3/1997 | Schworer | 249/210 |
| 2004/0075042 | A1 * | 4/2004 | Arozena Bergaretxe | 249/210 |

FOREIGN PATENT DOCUMENTS

| | | | |
|---|---|---|---|
| DE | 30 04 245 | C2 | 8/1981 |
| DE | 30 24 580 | C2 | 1/1982 |
| DE | 31 47 081 | A1 | 12/1982 |
| DE | 42 11 136 | A1 | 10/1993 |
| DE | 42 11 200 | A1 | 10/1993 |
| DE | 197 26 102 | A1 | 1/1998 |
| EP | 0 130 425 | A2 | 1/1985 |
| EP | 0 199 893 | A2 | 11/1986 |
| EP | 1 384 837 | A1 | 1/2004 |
| GB | 2 266 114 | A | 10/1993 |

* cited by examiner

*Primary Examiner* — Janet M Wilkens
*Assistant Examiner* — Timothy M Ayres
(74) *Attorney, Agent, or Firm* — Kilpatrick Townsend & Stockton LLP

(57) ABSTRACT

The invention relates to a slab formwork system comprising a plurality of formwork elements (98) which have on their underside girders (2) which can be coupled to heads (28) of vertical supports (90), in which slab formwork system the head of a vertical support has a lifting lock (44-51; 87) fixing a girder of a formwork element in the vertical direction. In addition, the head of a vertical support has fixing elements (52-66) which prevent a movement of the grider in its longitudinal direction.

31 Claims, 12 Drawing Sheets

SLAB FORMWORK SYSTEM

CROSS-REFERENCE TO RELATED APPLICATIONS

This application is a National Stage of International Application No. PCT/EP2007/002825, filed Mar. 29, 2007, and which claims the benefit of German Patent Application No. 10 2006 015 348.0, filed Apr. 3, 2006, the disclosures of both applications being incorporated herein by reference.

The invention relates to a slab formwork system having a plurality of formwork elements which have carriers couplable to heads of vertical supports at their lower side.

A slab formwork system of this type is known from document EP 0 130 425 A1. This system consists of formwork panels at whose lower sides C-shaped carriers are arranged which can be hooked with a head of a vertical support on a substantially vertical alignment of the formwork panels, whereupon the formwork panels can be pivoted into a horizontal position while maintaining the hook connection. To avoid a displacement of the carriers in their longitudinal direction relative to the head of the vertical support, the base section of the C-shaped carrier is provided with an opening into which a fixing element can engage which is fixedly connected to the head of the vertical support.

The fact is disadvantageous in the known slab formwork system that formwork elements mounted on the vertical supports can easily release from the vertical supports on a corresponding exertion of force, which can cause a considerable risk of an accident.

SUMMARY OF THE INVENTION

An object of the present invention can be seen in further developing a slab formwork system of the kind explained above such that a reduced risk of accident results.

This object is satisfied by embodiments described herein, and in particular in that the head of a vertical support has a lift-off safeguard fixing a carrier of a formwork element in the vertical direction, with the head of a vertical support additionally having fixing elements which prevent a movement of the carrier in its longitudinal direction relative to the head.

It is ensured by the lift-off safeguard provided in accordance with the invention that a formwork element once coupled to a vertical support can no longer subsequently be released from the vertical support or be displaced in an unintended manner by a movement of the formwork element directed substantially upwardly or in the longitudinal direction of the carrier. This is in particular of advantage during the assembly or dismantling phase, that is, before or after the application of the concrete to the slab formwork system since, in specific situations, force components which are directed upwardly or in the longitudinal direction of the carriers can by all means act on regions of formwork elements coupled to vertical supports, the force components then, in accordance with the prior art, being able to result in an unwanted and frequently dangerous lifting off of the formwork elements from the vertical supports or in an unintended displacement of the formwork elements relative to the vertical supports.

The lift-off safeguard is preferably made as a first hook element which is firmly, but optionally releasably, connected to the vertical support and engages into a second hook element, which is formed at the carrier of the respective formwork element, in the assembled position of a formwork element. The lift-off safeguard in accordance with the invention can thus be manufactured economically and efficiently, with it additionally being achieved that the effect of the lift-off safeguard can be realized solely by a hooking together of the first and second hook elements without parts or tools to be handled separately being necessary for this purpose. This also has a corresponding positive effect on the dismantling of the slab formwork system in accordance with the invention.

The carriers of the formwork elements can have an at least regionally C-shaped cross-section which has two limbs extending away from a base section, with one of these two limbs being designed as a second hook element. Since this second limb is anyway present with a C-shaped carrier, the second hook element can in this case be realized practically without any economic effort.

The limb of the carrier designed as a second hook element can furthermore form a support surface at least sectionally for the support of the carrier on a head of a vertical support so that this limb then has a dual function, which further increases the economy of the total arrangement.

The head of a vertical support can have fixing elements which each engage in a respective recess of the named support surface, with the recess being provided at the end of the support surface remote from the base section of the C-shaped carrier. It is particularly advantageous in this case if the first hook elements are formed at the fixing elements attached to the head of the vertical support. Such an embodiment will be explained in more detail within the framework of the description of the Figures.

It is particularly preferred if the carrier is couplable to the vertical support selectively in two directions offset by 90° to one another.

For example, when the recess for the fixing of the carriers in their longitudinal direction relative to the vertical support is not provided in the base section in accordance with the invention, but rather in the support surface, and there in the region remote from the base section, it becomes possible to arrange a plurality of fixing elements at the head of a vertical support such that a carrier can be fastened to the head of the vertical support in two directions offset by 90° with respect to one another. The variability of a slab formwork system in accordance with the invention is hereby increased with respect to known slab formwork systems in a manner such that the slab formwork system can be adapted in a respective ideal manner to individual circumstances by the selection possibility present on the attachment of formwork elements to a head of a vertical support.

Whereas, in accordance with the invention, the one limb of the carrier serves as a support surface and as a second hook element for the interaction with a vertical support, the other limb of the carrier can be made as a contact surface for a plurality of longitudinal members of a grid element onto which ultimately a sheathing can then be applied. Alternatively, the other limb can, however, also be made as a contact surface for a formwork panel, with in this case, unlike the use of a grid element, no further elements being located between the carrier in accordance with the invention and the formwork panel.

The carriers being used in accordance with the invention are preferably made as open sectional elements. Alternatively, however, closed sections can also be used. In the latter case, the described recess is likewise to be provided in the region of the respective support surface which is brought into contact with the vertical supports.

It is preferred for the support surface of the carrier respectively to have two or more recesses in each of the two mutually remote end regions of the carrier. This plurality of recesses then makes it possible to couple a carrier to a vertical support at different positions distributed over its length so that in turn different installation situations can be taken into account, but simultaneously the lift-off safeguard in accordance with the invention is realized at each selected position.

It is of advantage in this connection for at least two recesses of the support surface and two fixing elements of the head of a vertical support to be mutually spaced apart such that a simultaneous engagement of each of the two fixing elements is made possible in one each of the two recesses. In this case, the carrier can then either be installed at a vertical support via the named simultaneous engagement such that it terminates flush with its head, or an installation can be carried out such that the carrier projects over the head of the vertical support at both sides. When a corresponding number of pairs of recesses is provided, the carrier can project beyond the head of the vertical support over different lengths matched to the respective circumstances. These different lengths can be set simply by the selection of a suitable pair of recesses.

Even on the provision of at least two recesses in the support surface in one or both end regions of the carrier, it is possible to couple the carrier only via one of the two recesses with a fixing element of the head of a vertical support. This coupling variant is in particular selected when two carriers aligned with one another in the longitudinal direction should be fastened to a common head of a vertical support.

It is particularly preferred for the support surface to have at its end region remote from the base section an upwardly extending or angled lug, preferably extending parallel to the base section, which is provided with a cut-out, in particular of V shape, which is aligned with the recess provided in the support surface such that the cut-out and the recess merge into one another. In this case, the assembly of a formwork element at a vertical support is particularly simple since the correct positioning between the recess provided in the support surface and the fixing element of the respective head is facilitated by the named cut-out. Specifically, a carrier provided with the lug can be positioned above a head of a vertical support such that the cut-out present in the lug is located directly above the respective fixing element of the head, whereupon a lowering of the carrier onto the head can then take place in which the fixing element of the head is "threaded" into the cut-out of the lug. It is then achieved by a subsequent pivoting of the formwork element around a pivot axis extending parallel to the longitudinal axis of the carrier that the fixing element is introduced in a compulsory manner via the cut-out provided in the lug into the recess of the support surface corresponding therewith. The guiding of the fixing element to the recess of the support surface is in particular promoted by the V shape of the cut-out in the lug, with the width of the V-shaped cut-out growing as the spacing from the corresponding recess in the support surface increases.

It is furthermore advantageous for the lug to have two or more respective cut-outs of the named kind in each of the two mutually remote end regions of a carrier, the cut-outs being aligned in each case with corresponding recesses in the support surface. In this case, a corresponding cut-out can then be provided in the lug for each recess in the support surface so that the introduction of the fixing element into any desired recesses of the support surface is facilitated.

The lower side of the support surface preferably extends obliquely upwardly in its assembled position starting from the base section so that in particular the angle between the lower side of the support surface and the base section is smaller than 90° and preferably amounts to between 70° and 80°. It is achieved by this measure that the disassembly of a formwork element in accordance with the invention can be carried out without a problem since a pivoting away of a formwork element around an axis extending parallel to the carrier is not impeded by an upward movement of surface regions of the formwork element. This is in particular made clear on an observation of FIGS. 5*a-c* explained below.

The vertical supports can in each case be provided with a support head which, in addition to a support plane extending perpendicular to the longitudinal extent of the respective vertical support, has fixing lugs angled therefrom for engagement into a respective recess of the support surface of a carrier. In this case, the fixing elements of the support head explained above are formed at the fixing lugs. The use of angled fixing lugs is advantageous in that an element can be used for the support head which is plate-shaped in the raw state and from which specific regions, preferably corner regions, can be bent upwardly as fixing lugs so that it is not necessary to apply separate fixing elements to the support head. Alternatively, however, it is also possible to make the support head as a cast part or a forged part or also to make it from plastic.

Eight fixing lugs, for example, can be provided per support head which in particular extend perpendicular to the support plane of the support head.

The support plane is preferably made substantially square or rectangular, with it then being able to have a respective two adjacent fixing lugs at each of its four corner regions, the fixing lugs each extending perpendicular to one another.

It is particularly advantageous if fixing elements which simultaneously have first hook elements are only formed at some of the plurality of fixing lugs. This means that the lift-off safeguard in accordance with the invention is only realized with a coupling of formwork elements to such fixing lugs whose fixing elements are made as first hook elements. If, however, such fixing lugs are used for the establishing of a connection between the formwork element and the vertical support whose fixing elements are not made as first hook elements, the lift-off safeguard in accordance with the invention is directly dispensed with. This can by all means be sensible and advantageous in specific applications, for example when it is necessary due to the given installation situation to place a formwork element onto the vertical supports associated with it from above so that in this case the first hook elements would collide with the second hook elements. In contrast, such a placing on taking place vertically from above becomes possible by the omission of the first hook elements. It is furthermore necessary in specific applications directly to strip a slab formwork at a specific point in the interior region in order to provide an access way in this manner, for example. In such a case, the formwork element to be stripped must be raised vertically upwardly, which would not be possible with a provision of first hook elements in the region of the vertical supports.

In this respect, it is sensible in order to maintain the flexibility, to provide both fixing lugs with first hook elements and fixing lugs without first hook elements, at least with specific support heads, since such a support head can then selectively be used such that a lift-off safeguard is achieved or actually such that a lift-off safeguard is deliberately avoided. It is particularly preferred in this connection if fixing lugs of a support head which extend in a first direction have fixing elements with first hook elements and if fixing lugs of the same support head which extend in a second direction extending perpendicular to the first direction have fixing elements which are free of first hook elements.

If then formwork elements which extend perpendicular to the first direction are coupled to such a support head, a lift-off safeguard is provided. If, however, the formwork elements extend perpendicular to the second direction, a lift-off safeguard is deliberately omitted.

It is particularly advantageous for the support head to have abutment regions for the rear side of the base section of a carrier remote from the limbs, with the abutment surfaces of the abutment regions in particular extending perpendicular to the support plane. With a carrier coupled to such a support head, regions of the fixing elements or fixing lugs are located, at the end of an assembly procedure in the recesses of the support surface made complementary thereto, with simultaneously the rear side of the base section being supported at the named abutment regions or coming to lie only at a small spacing from these abutment regions. These abutment regions thus prevent the fixing elements from being able to be moved out of the named recesses so that a reliable and defined fixing of a carrier to a support head is ensured here.

A total of eight abutment regions are preferably provided whose abutment surfaces in particular extend at an angle of 90° to the fixing lugs associated with them in each case. These eight abutment regions make it possible for a respective carrier to be able to be secured to the support head at four different positions, with two alignments of the carrier offset by 90° with respect to one another being possible in a horizontal plane at each of these four positions. Overall, therefore, four different carriers can be simultaneously arranged at a support head, with the alignment of each individual carrier being able to be selected individually.

The named abutment regions of the support head can be formed by separate abutment elements which are subsequently coupled to the support head. It is, however, preferred for four abutment regions to be formed by a section of the support head, or of the plate-shaped element from which the support head is made, bent into a substantially U shape and extending upwardly from the support plane. Two further abutment regions each can be formed in each case by one abutment lug bent upwardly out of the support plane. In this manner, the use of separate elements can be completely avoided and it is furthermore possible to produce the total support head from one single plate-shaped element.

The support head used in accordance with the invention can be connected to the vertical support associated with it either releasably or also fixedly.

It is particularly advantageous for the support head to be able to be coupled with a preferably substantially square head plate of a commercial vertical support, with the sizes of the head plate and the support head being able to be approximately the same with respect to one another. In this connection, the support head can be able to be pushed onto the head plate in a direction extending parallel to the head plate of the vertical support. The lower side of a support plane of the support head preferably comes to lie directly on the head plate of the vertical support in the assembled position such that no elements are needed which extend the vertical support beyond its head plate. The spacing between the upper side of the head plate of the vertical support and the support plane of the support head therefore corresponds, in this advantageous embodiment, substantially to the thickness of the material used for the support head.

When a releasable connection is provided, the support head can—as already mentioned—be pushed onto a vertical support in a direction extending parallel to its support plane and can be fixed there, in particular by means of a spring member held in the support head. This spring member then represents the only element of the support head which cannot be made from one plate-shaped base element. When made from plastic, the spring member can also be made integrally with the support head.

It is preferred in accordance with the invention for all support heads, vertical supports and/or end regions of the carriers used to be made the same with respect to one another. This then makes possible any desired combination variants and avoids the erroneous handling of individual components of the slab formwork system in accordance with the invention.

The assembly of a slab formwork system in accordance with the invention can be carried out particularly comfortably for a fitter when the vertical support and the carrier of a formwork element can be hooked to one another in such a position in which the formwork element and the vertical support include an angle smaller than 90°. It is preferred in this connection for the formwork element to extend substantially parallel to the respective vertical support or to the respective vertical supports on the establishing of this hook connection.

After the hooking together, a pivoting of the formwork element can then take place while maintaining the hook connection into such a position in which the formwork element and the vertical supports include an angle of approximately 90° so that the formwork element extends in a horizontal plane in which it can ultimately be used for the production of a concrete ceiling. The first and second hook elements in accordance with the invention are also then disposed opposite one another in this position so that the intended effect of a lift-off safeguard is present.

The formwork elements used in accordance with the invention can, for example, consist in each case of longitudinal members extending parallel to and spaced apart from one another which are fixedly connected to at least one cross member extending perpendicular thereto, with the upper sides of the longitudinal members forming a contact surface for a sheathing, the upper side of the cross-member or members contacting the lower side of the longitudinal members and the lower side of the cross member or members forming a support surface of the described type. In this case, the formwork elements in accordance with the invention therefore form grid elements which are first installed onto the vertical supports, whereupon the sheathing or the formwork panels can be applied to the grid elements.

Alternatively, however, it is also possible to form the formwork elements such that a sheathing is applied directly to the carrier explained above, in particular onto its upper sides. In this case, already completed formwork panels comprising sheathing and carriers are installed on the vertical supports in the manner in accordance with the invention.

BRIEF DESCRIPTION OF THE DRAWINGS

The invention will be described in the following with reference to embodiments and to the drawings; there are shown in these.

DETAILED DESCRIPTION OF THE INVENTION

Figure 1:
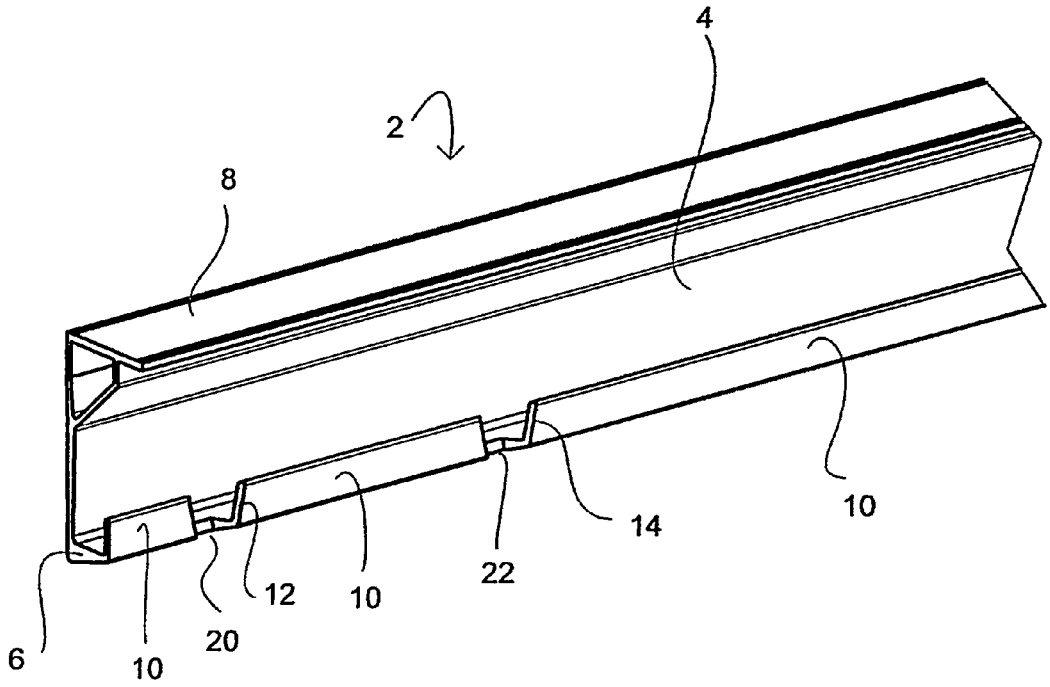
FIG. 1 is a three-dimensional view of an end section of a carrier being used within the framework of the invention and couplable to the head of a vertical support.

The carrier 2 shown in FIG. 1 is made as an open elongated section element which has a C-shaped section with two limbs extending away from a base section 4, with the lower limb being designed as a support surface 6 for placing on a head of a vertical support. The upper limb supported at the base section 4 for reinforcement with a diagonal strut 7 forms a support surface 8 for the lower sides of longitudinal members which extend, for example, perpendicular to the carrier 2, which forms a cross member in this case, so that the named longitudinal members, together with the carrier 2 and optionally with further cross members, form a grid element onto which a sheathing can be applied. Alternatively, the contact surface 8 can also serve directly as a contact surface for a sheathing.

In the carrier 2 shown, the base section 4—viewed in cross-section—is longer than the contact surface 8, which is in turn longer than the support surface 6. The length of the contact surface 8 amounts to approximately twice the length of the support surface 6, whereas the length of the base section 4 amounts to approximately twice the length of the contact surface 8.

The lower side of the support surface 6 does not extend parallel to the contact surface 8, but rather obliquely upwardly in the direction of the contact surface 8. It results in this manner that the thickness of the support surface 6 becomes smaller as the spacing from the base section 4 increases, since the upper side of the support surface 6 facing the contact surface 8 extends, unlike its lower side, parallel to the contact surface 8. The advantages of this design will be explained in the following in connection with FIGS. 5*a-c*.

An upwardly angled lug 10 is shaped on the end of the support surface 6 remote from the base section 4 and extends parallel to the base section 4 in the direction of the contact surface 8. Alternatively to the named angling, a round transition could also be formed between the support surface 6 and the lug 10 so that e.g. substantially the shape of a quarter-circle is adopted in cross-section between the support surface 6 and the lug 10. The lug 10 in the embodiment shown is provided with two V-shaped cut-outs 12, 14, 12, 14 which are spaced apart from one another in the longitudinal direction of the carrier 2, with the width of these cut-outs 12 to 18 each reducing as the spacing from the contact surface increases. The cut-outs 12 to 14 extend over the total height of the lug 10 and merge in their lower end region into recesses 20, 22, of the support surface 6. The width of the recesses 20 to 22 in this process corresponds approximately to the width of the V-shaped cut-outs 12 to 14 in their end region facing the recesses 20 to 22. The recesses 20 to 22 extend into the support surface 6 by less than half the length of the support surface 6.

Due to their U-shaped design, the cut-outs 12 to 14 can form a "threading aid" for the introduction of fixing elements into the recesses 20 to 22 by the named arrangement of the cut-outs 12 to 14 and of the recesses 20 to 22, with this threading aid in particular being effective when the carrier 2 is pivoted upwardly by 90° into its position shown in FIG. 1 after the guiding up to a fixing element. This pivot movement is promoted by the explained oblique orientation of the lower side of the support surface 6.

Only an end region of the carrier 2 is shown in FIG. 1. The other end region, not shown, of the carrier 2 is made analogously to the end region shown so that the carrier 2 has two respective cut-outs 12 to 14 and two recesses 20 to 22 in each of its two end regions.

Figure 2:
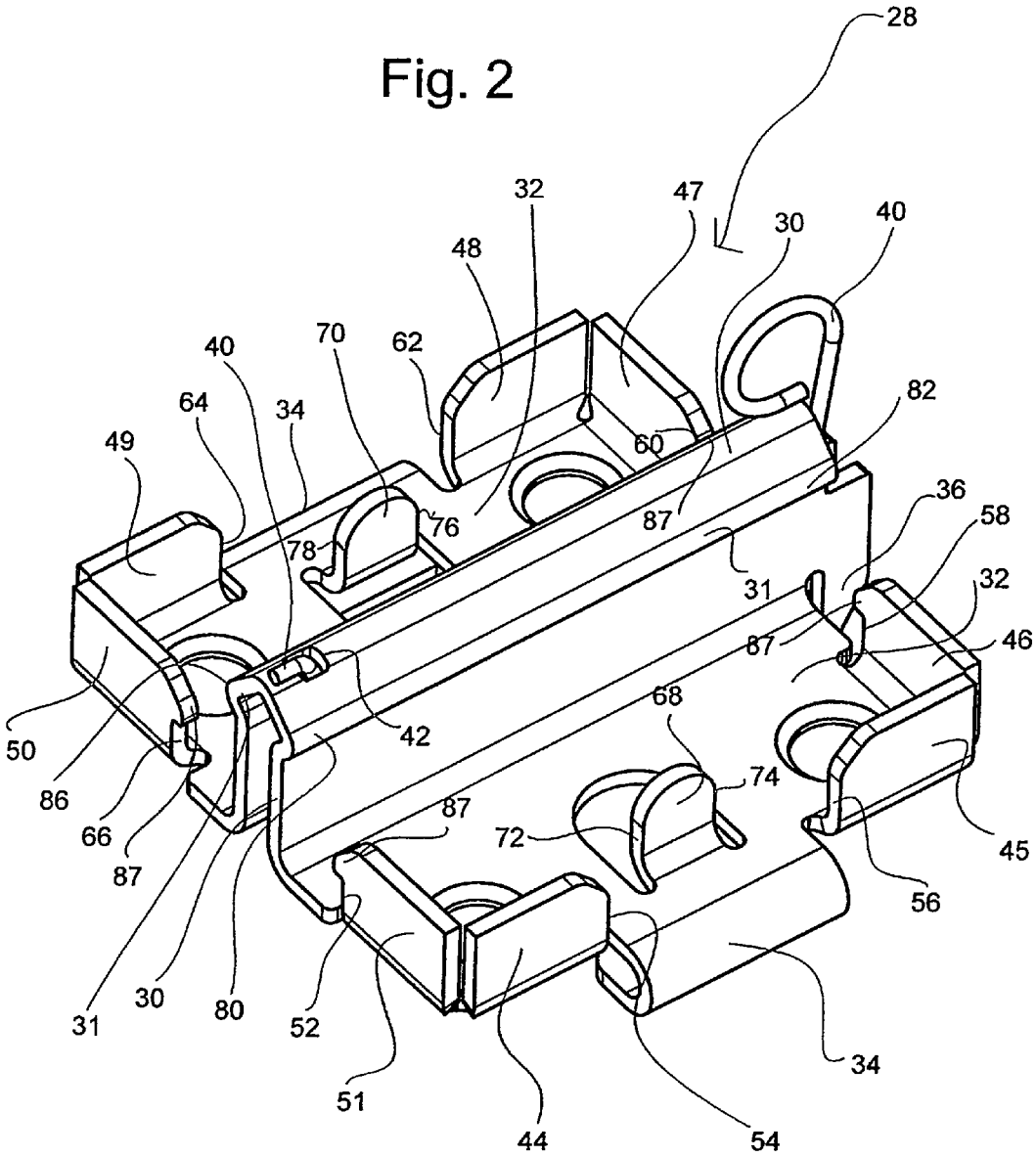
FIG. 2 is a three-dimensional view of a head of a vertical support couplable to a carrier in accordance with FIG. 1 obliquely from above.

FIG. 2 shows in a three-dimensional view a head 28 which can be coupled to a vertical support (not shown). In this connection, the head 28 is made from a steel plate which was originally substantially rectangular and which is bent such that a section 30 is formed in its middle region which is bent substantially into a U-shape, which extends upwardly over the whole width of the head 28 and which has one respective outwardly projecting abutment bead 31 at both sides in its upper section. The U-shaped section 30 in this process divides the base surface of the head 28 formed as a support plane 32 into two halves of equal size between them. With carriers 2 installed at the head 28, the named support plane 32 absorbs the vertical forces to be transmitted from the carriers 2 onto a vertical support since the support surface 6 of a carrier 2 is ultimately supported on the support plane 32 of the head 28, which will be explained in the following.

Spaced apart perpendicularly from the U-shaped section 30, the support plane 32 has a respective coupling lug 34 which is curved downwardly in U shape at its two end regions remote from one another so that a receiving plane for a head plate (not shown) of a vertical support is defined between the coupling lugs 34 facing one another which extends parallel to the support plane 32. A head plate of this type can be pushed in the longitudinal direction of the U-shaped section 30 into the coupling lugs 34 until it abuts two abutment members 36 which are made integrally with the U-shaped section and extend downwardly, starting from this, into the named receiving plane for the head plate of the vertical support. Only one of these abutment members 36 can be seen in FIG. 1.

A spring member is fastened in the hollow space surrounded by the U-shaped section 30. The end sections 40 of the spring member 38 are curved in the region of an opening 42 of the U-shaped section 30 and in the region of an end-face end of the U-shaped section 30 such that the spring member 38 is captively held at the head 28. The spring member 38 is shaped in this process such that a middle section of the same extends downwardly at least up to and into the receiving plane provided for the head plate of a vertical support and formed between the coupling lugs 34 such that the named section of the spring member 38 can snap into an end face hollow space of a vertical support or of a head plate of a vertical support, whereby the head 28 can be fixed in a defined position with respect to a vertical support. In such a position, the two abutment elements 36 abut an edge of the head plate of a vertical support. When the head 28 is pulled from a vertical support, the spring member is deformed by the removal force such that the spring member ensures a correct positioning of the head 28 relative to the vertical support, on the one hand, but also permits a subsequent release of the head 28 from a vertical support, on the other hand.

The four corner regions of the support plane 32 are each bent upwardly perpendicular to the support plane 32 so that they form a total of eight fixing lugs 44-51 which each extend either perpendicular or parallel to the longitudinal direction of the U-shaped section 30. Two respective fixing lugs 51, 44; 45, 46; 47, 48; 49, 50 oriented perpendicular to one another and adjacent to one another are associated with one respective corner each of the support plane 32. The width of the fixing lugs 44 to 51 amounts to somewhat more than twice their height, with the corner regions of the fixing lugs 44 to 51 remote from the support plane 32 in each case being chamfered. Each perpendicular edge 52, 54; 56, 58; 60, 62; 64, 66 of the fixing lugs 44 to 51 in this process forms a respective fixing element which is suitable in the sense of the invention for an engagement into a recess 20 to 26 of a carrier 2. On a coupling of a carrier 2 via one of the fixing lugs 44 to 51, in each case only one of the two fixing elements 52 to 66 of a fixing lug 44 to 51 always becomes effective. The provision of two fixing elements 52 to 66 per fixing lug pair 51, 44; 45, 46; 47, 48; 49, 50 makes it possible selectively to couple a carrier 2 to a fixing lug 44 to 51 in two directions offset to one another by 90° and extending parallel to the support plane 32.

An abutment lug 68, 70 is bent upwardly out of each of the two halves of the support plane 32, with each of the two end face edges extending perpendicular to the support plane 32 of the abutment lugs 68, 70 each forming an abutment surface 72, 74, 76, 78 for the rear side of the base section 4 of a carrier 2.

Four further abutment surfaces 80, 82, 84, 86 are formed by regions of the U-shaped section 30, in particular by its abutment beads 31, extending perpendicular to the support plane 32. These abutment surfaces 80 to 86 are also each suitable to cooperate with the rear side of the base section 4 of a carrier 2.

Specifically, a carrier 2 can be fixed between the following pairs of mutually respectively oppositely disposed fixing elements 52 to 66 and abutment surfaces 72 to 86:

52, 80; 54, 72; 56, 74; 58, 82; 60, 84; 62, 76; 64, 78; 66, 86.

In accordance with the invention, all those fixing lugs 46, 47, 50, 51 which extend perpendicular to the longitudinal direction of the U-shaped section 30 each have a first hook element 87 at their fixing elements 58, 60, 66, 52 which extends in each case toward the U-shaped section 30 and, viewed from above, forms an undercut which can be engaged behind by a second hook element or by a support surface 6 of a carrier 2.

The other fixing elements 54, 56, 62, 64 of the remaining fixing lugs are free of first hook elements 87. It is achieved in this manner that a carrier 2 extending parallel to the longitudinal direction of the U-shaped section 30 and coupled to the head 28 is secured against a lifting off from the head 28 by first hook elements 87, whereas a carrier 2 extending perpendicular to the longitudinal direction of the U-shaped section 30 and coupled to the head 28 can lift vertically upwardly from the head 28 due to the lack of first hook elements 87 at the fixing elements 54, 56, 62, 64.

Figure 3:
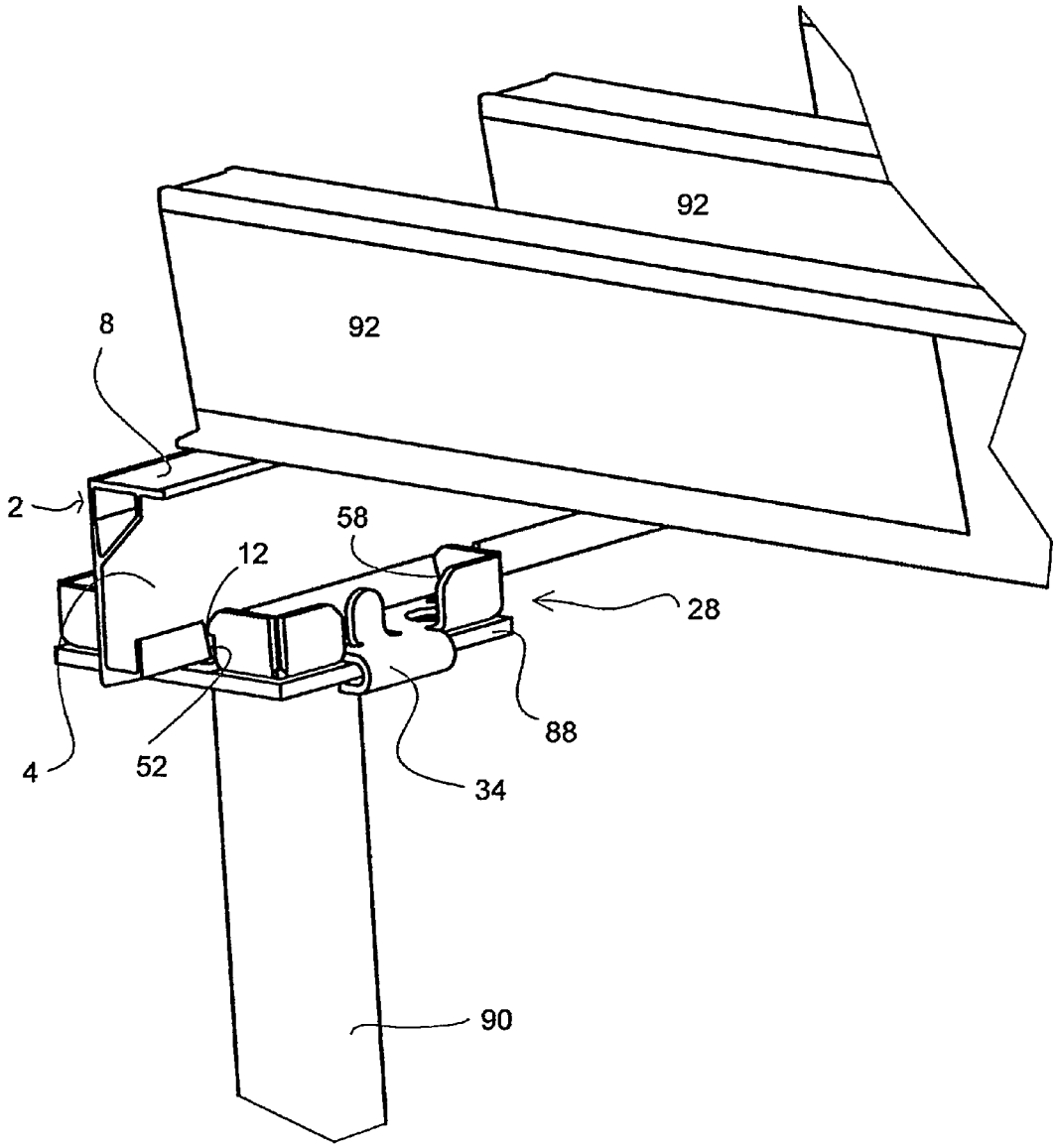
FIG. 3 is a three-dimensional view of a carrier in accordance with FIG. 1 coupled to a head of a vertical support in accordance with FIG. 2 in a first fastening position obliquely from above.
Figure 4:
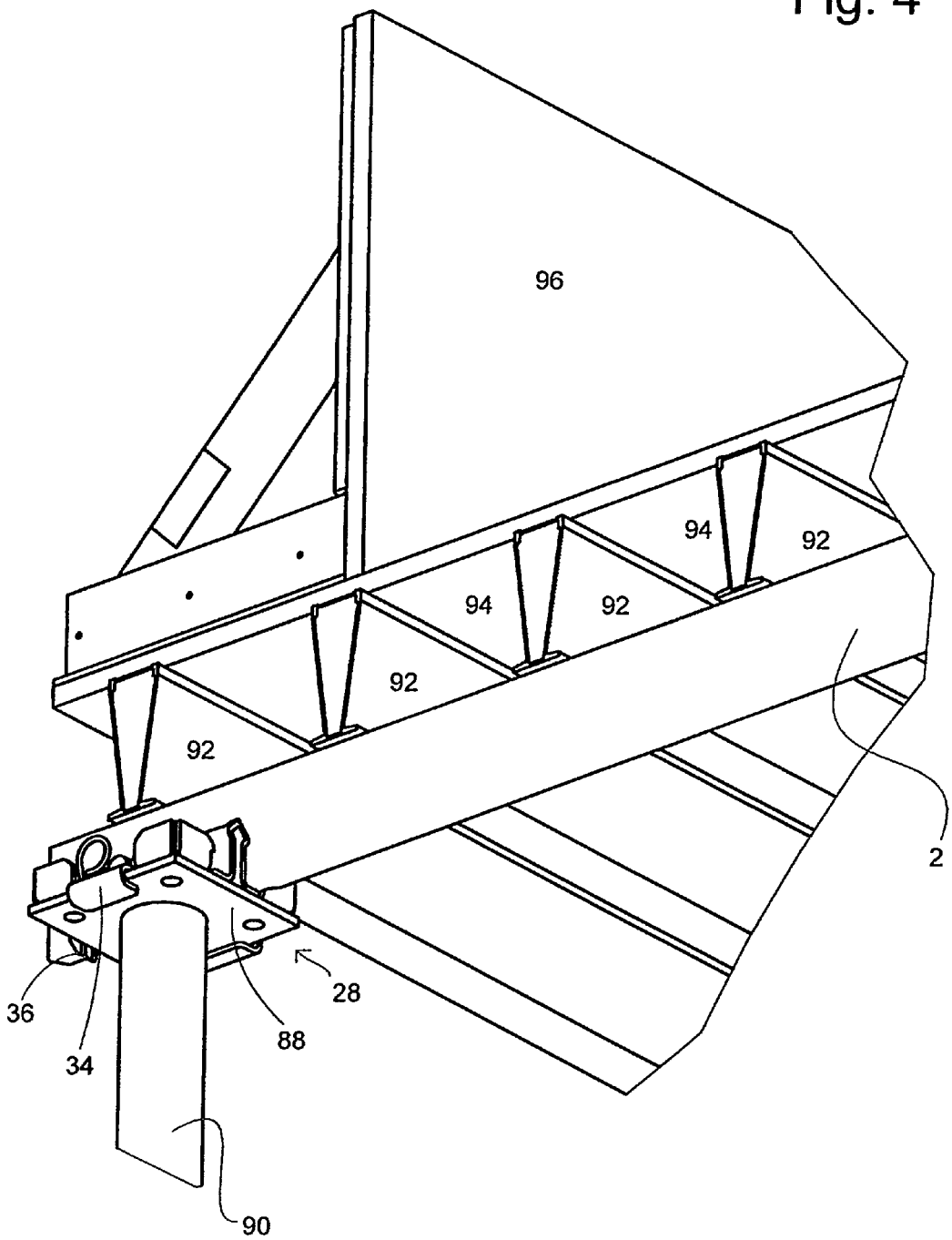
FIG. 4 is a view in accordance with FIG. 3 obliquely from below with the realization of a second fastening position.

FIGS. 3 and 4 show a head plate 88 of a vertical support 90 which is pushed so far into coupling lugs 34 of a head 28 until an edge of the head plate 88 abuts the abutment elements 36 of the head 28. A respective carrier 2 in accordance with FIG. 1 is coupled to the head 28 and longitudinal members 92 are fastened to its contact surface 8 and extend perpendicular to the carrier 2. In accordance with FIG. 4, a sheathing 94 is secured to the upper side of the longitudinal members 92 and is in turn coupled to a bulk formwork 96.

In accordance with FIGS. 3 and 4, the carrier 2 is coupled to the head 28 such that the fixing element 52 extends into the cut-out 12 and into the recess 20 (FIG. 1). At the same time, the fixing element 58 extends into the cut-out 14 and the recess 22 (FIG. 1). The base section 4 of the carrier 2 in this process is supported at its rear side at the abutment surfaces 80 and 82 so that ultimately these abutment surfaces 80, 82, together with the fixing elements 52, 58, effectively prevent the carrier 2 from being able to move perpendicular to its base section 4. The engagement between the fixing elements 52, 58 and the recesses 20, 22 simultaneously ensures that no movement can take place relative to the head 28 in the longitudinal direction of the carrier 2.

Alternatively, the carrier 2 could also be coupled to the head 28 in a position which is offset in the longitudinal direction of the carrier 2 and in which the fixing element 58 would engage into the cut-out 12 or into the recess 20 corresponding therewith.

In this case, the carrier 2 would then no longer extend beyond the whole support plane 32 of the head 28 as in accordance with FIGS. 3 and 4. It would rather only extend over less than half the width of the support plane 32 so that, for example, a further carrier 2 could be coupled to the head 28 via the fixing element 52 so that both carriers 2 would extend aligned with one another in the longitudinal direction.

Finally, a carrier 2 could also be coupled to the head 28 via its cut-outs 12, 14 or recesses 20, 22 such that it extends perpendicular to its alignment shown in FIG. 3. In this case, the fixing element 54 would then engage into one of the recesses 20, 22, with the rear side of the base section 4 of the carrier being supported at the abutment surface 72 of the abutment lug 68.

It is in particular also possible to couple two, three or four carriers 2 to the head 28, with each of the carriers 2 then being able to be fixed between one of the pairs of fixing elements 52 to 66 and abutment surfaces 72 to 86 already named above. The individual carriers 2 can extend parallel or also perpendicular to one another.

Figure 5A:
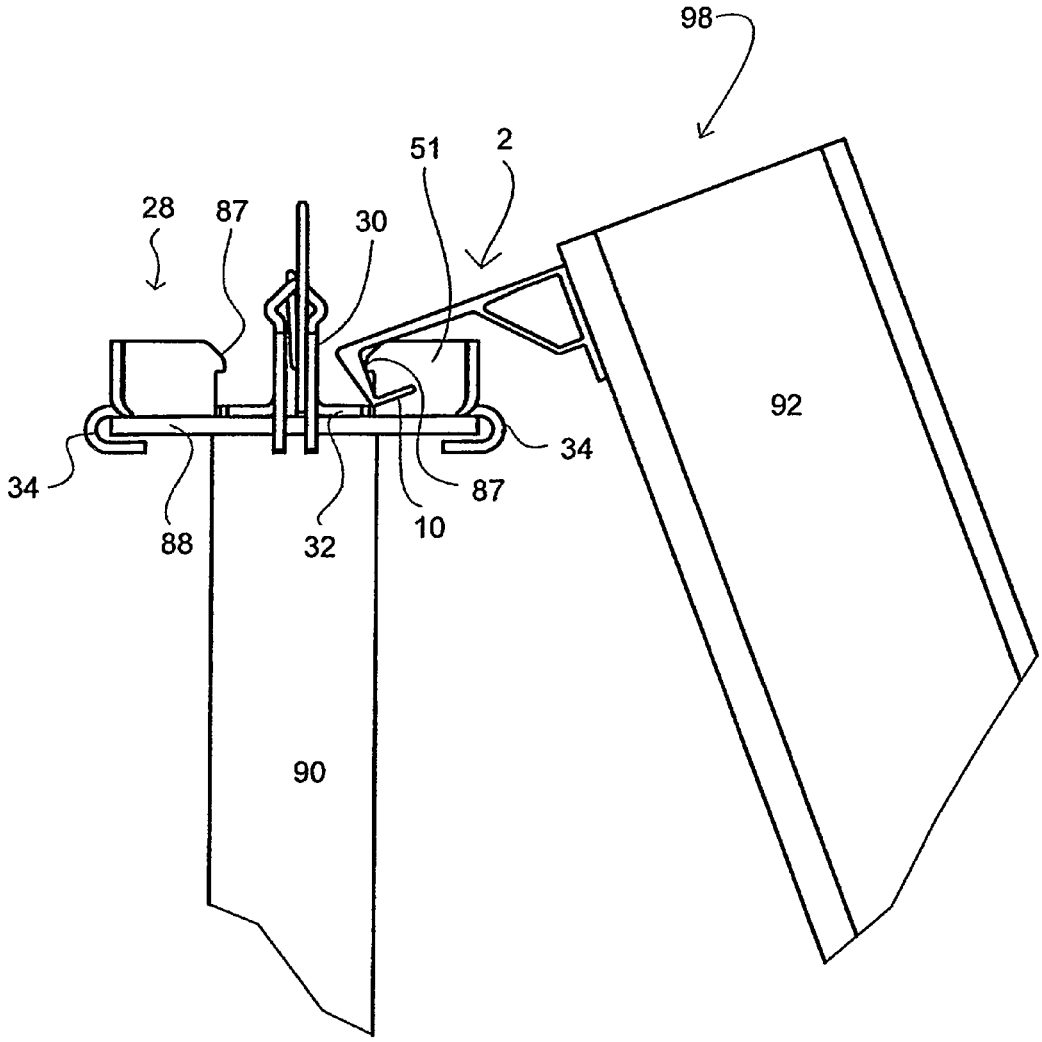
FIGS. 5*a-c* illustratre different method steps in side view, on the coupling of a carrier in accordance with FIG. 1 with a head in accordance with FIG. 2.
Figure 5B:
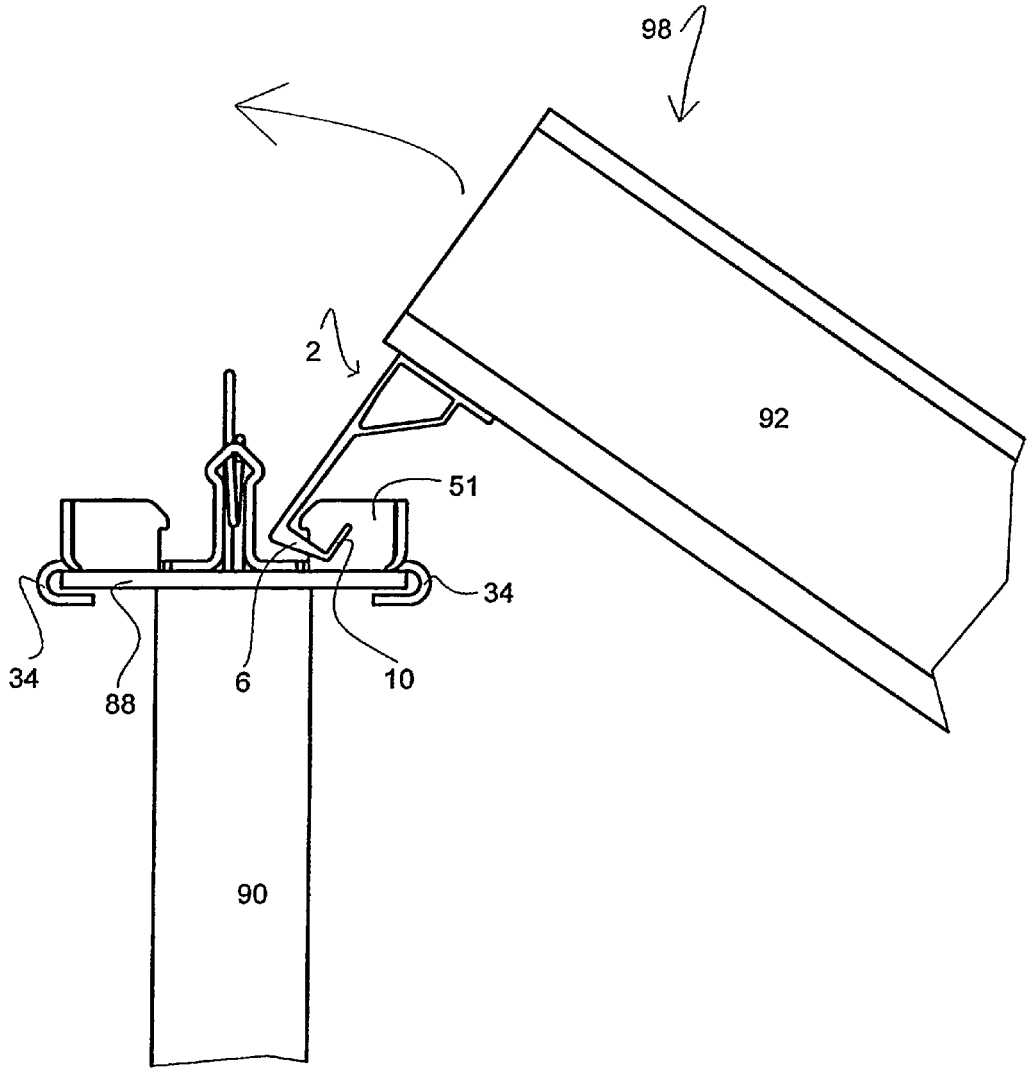
Figure 5C:
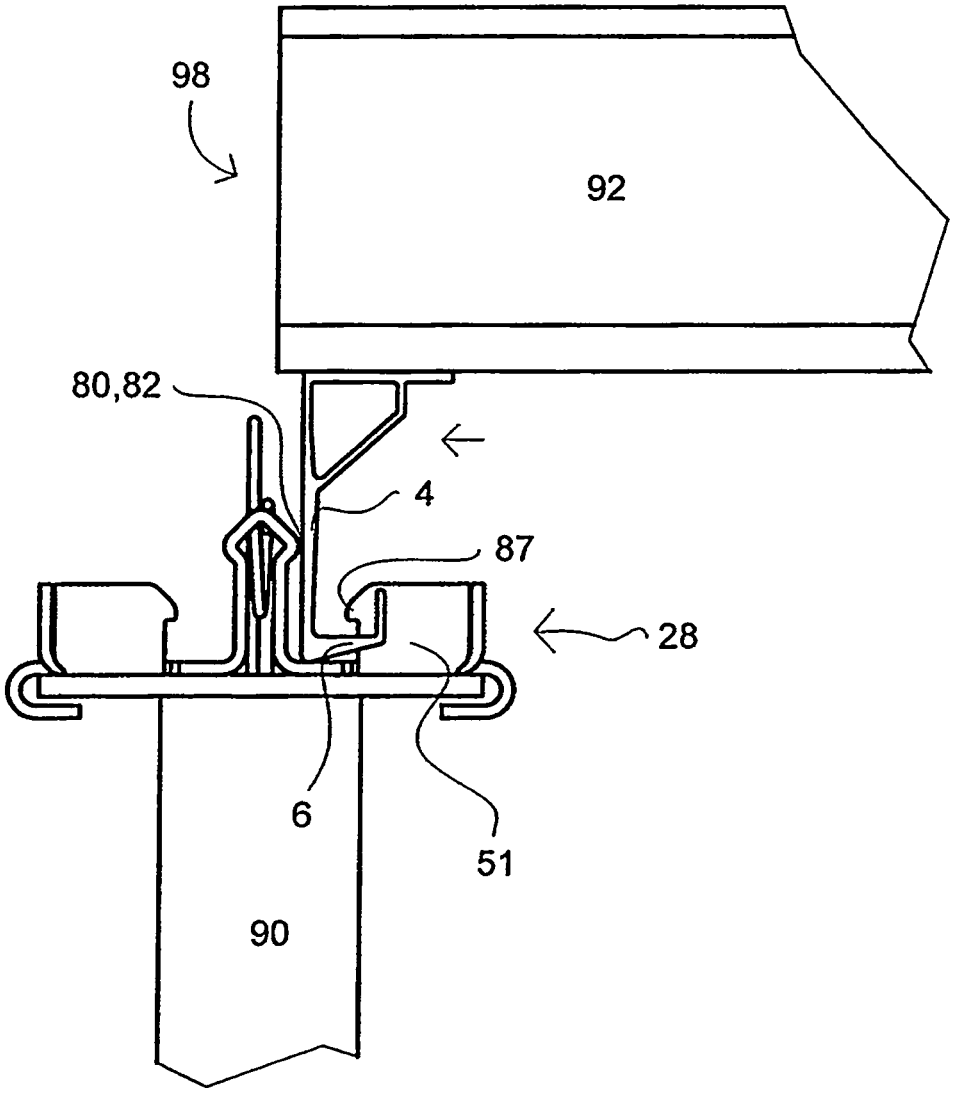

FIGS. 5*a-c* show how a coupling can be established between the carrier 2 and the head 28 as is shown in FIG. 3.

First, a formwork element 98 comprising carriers 2 and longitudinal members 92 is aligned relative to a vertical support 90 such that the longitudinal members 92 extend either substantially parallel to the vertical support 90 or—as shown in FIG. 5*a*—somewhat obliquely to this alignment. In this alignment, a formwork element 98 can be taken up easily and raised by a fitter such that the carrier 2 is ultimately located above a head 28 of the vertical support 90. Starting from this raised position, the formwork element 98 is then aligned and lowered by the fitter such that the fixing elements 52, 58 are introduced into the V-shaped cut-outs 12, 14 of the lug 10. This introduction is facilitated by the V shape of the cut-outs 12, 14. The first hook elements 87 of the fixing elements 52, 58 only project so far in the direction of the U-shaped section 30 that the named introduction is not impeded. In this manner, a hook connection is therefore already established between the head 28 and the carrier 2 in which the weight of the formwork element 98 can be led to a greater part via the support plane 32 into the vertical support 90 such that the person carrying out the assembly no longer has to hold the full weight of the formwork element 98.

Starting from the hook connection in accordance with FIG. 5*a*, the formwork element 98 in accordance with FIG. 5*b* is now pivoted upwardly in the arrow direction around a pivot axis extending parallel to the longitudinal axis of the cross member 2, with the fixing elements 52, 58—guided by the V-shaped cut-outs 12, 14—automatically being moved into the recesses 20, 22 of the support surface 6 of the carrier 2 during this pivot movement. The named pivot movement is continued for so long until the position in accordance with FIG. 5*c* is reached in which the formwork element 98 and its longitudinal member 92 extend perpendicular to the vertical support 90 in the horizontal direction. It can be seen particularly illustratively from FIG. 5*c* that the abutment surfaces 80, 82 in this completely mounted position effectively prevent the carrier 2 from moving in the arrow direction perpendicular to the base section 4 of the carrier 2 such that the fixing elements 52, 58 move out of engagement with the recesses 20, 22. FIG. 5c furthermore shows that the first hook elements 87 were moved solely by the named pivot movement into a position in which they engage over the recess-free region of the support surface or of the second hook elements 6 such that the formwork element 98 cannot be raised perpendicularly upwardly parallel to the base section 4. A release from the head 28 and from the formwork element 98 is consequently only possible when the formwork element 98 is pivoted downwardly against the direction of the arrow of FIG. 5b.

If, within the framework of the dismantling of the formwork element 98, work is carried out in the reverse order, as described in connection with FIGS. 5a-c, the slope formed at the lower side of the support surface 5 which includes an angle of approximately 75° with the base section 4 comes advantageously into effect. It namely becomes possible on the basis of this slope to pivot the formwork element 98 away, starting from the position in accordance with FIG. 5c, against the arrow direction of FIG. 5b, without a clamping effect occurring between the upper side of the formwork element 98, a sheathing lying thereon and an already prepared concrete slab. The slope rather ensures that all parts of the formwork element 98 move downwardly on the pivoting away such that a problem-free stripping becomes possible.

Figure 6A:
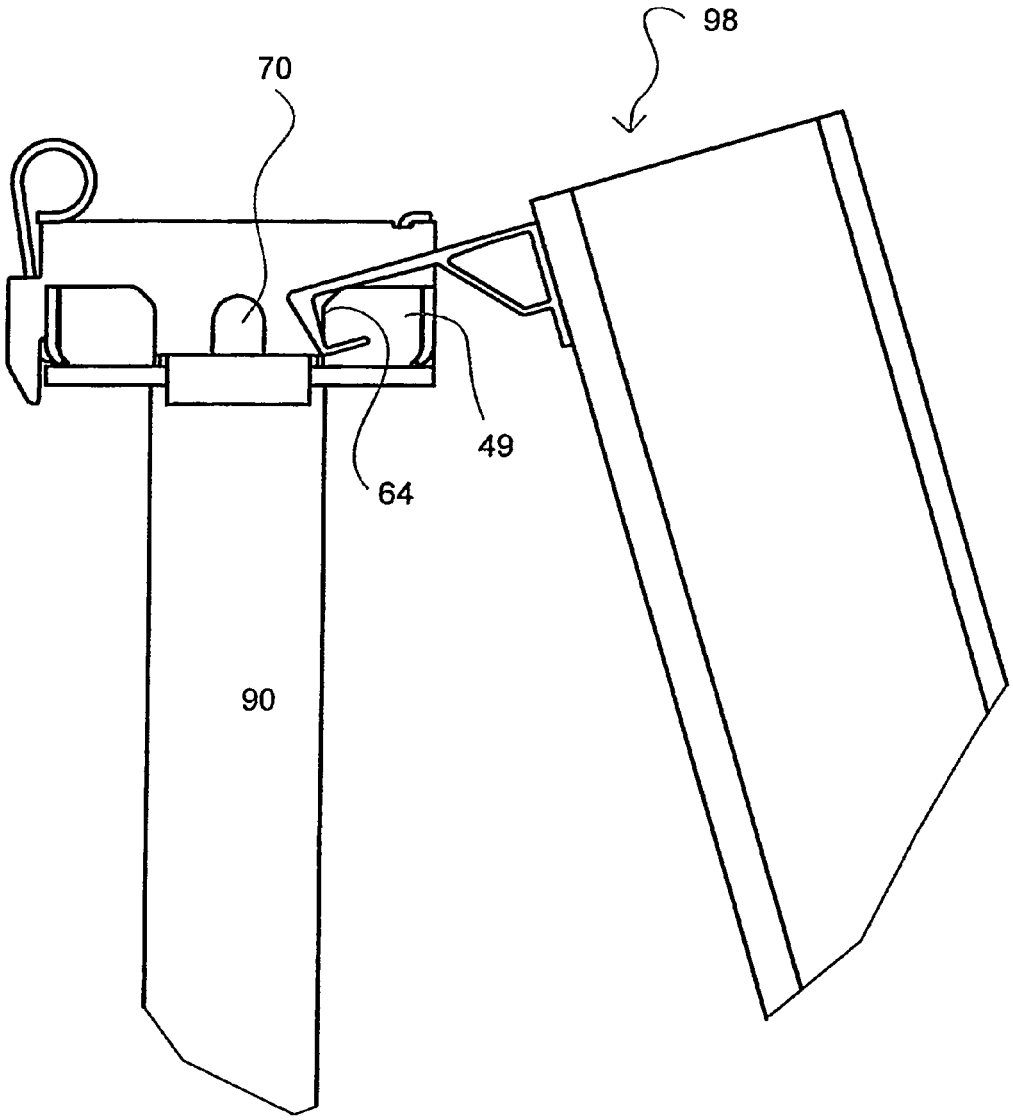
FIGS. 6*a-c* are views similar to FIGS. 5*a-c*, with a head of a vertical support rotated by 90°.
Figure 6B:
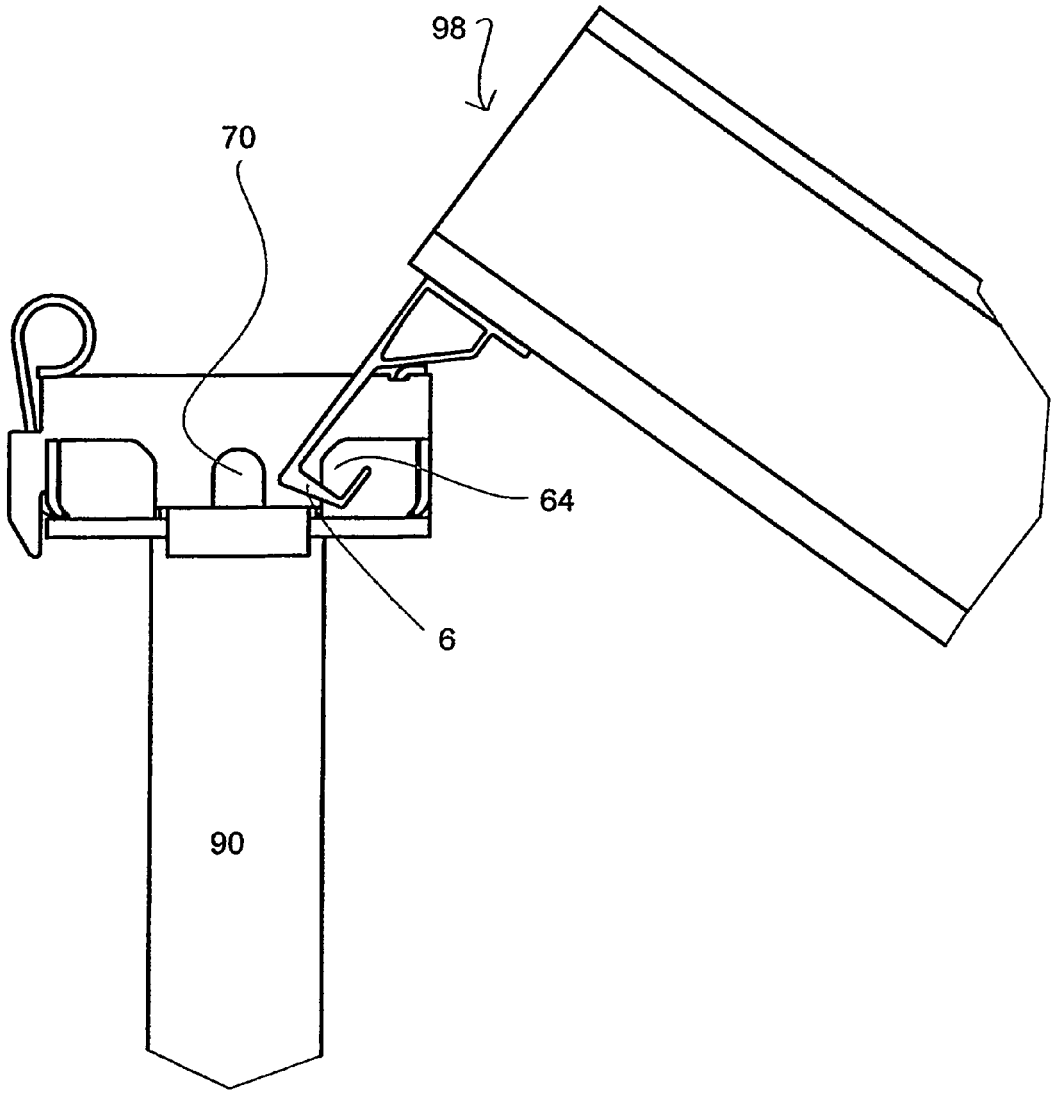
Figure 6C:
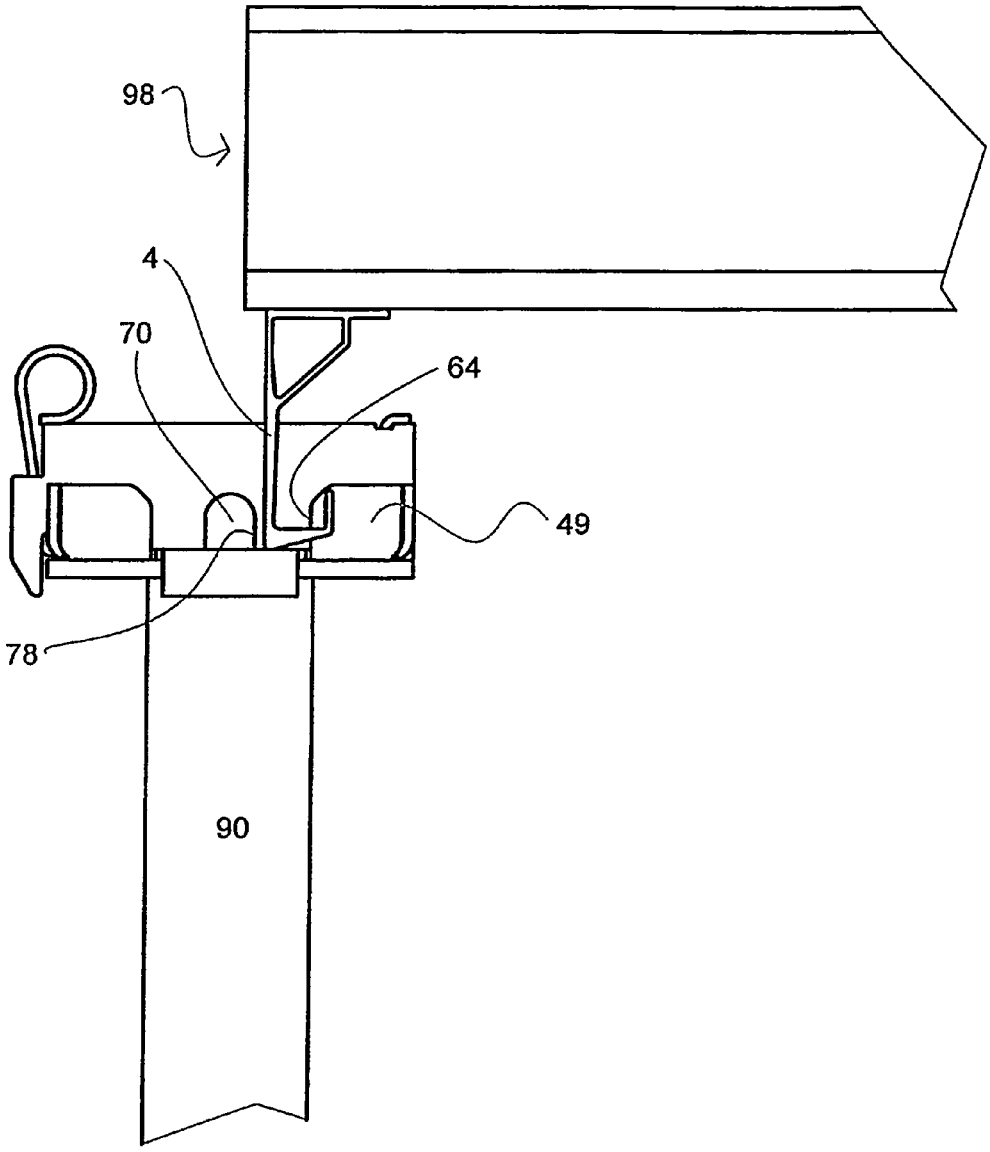

FIGS. 6a-c illustrate that a corresponding coupling process can be realized when it is ultimately desired for the fully installed formwork element 98 to extend at an angle relative to the head 28 offset by 90° with respect to FIGS. 3 and 5a-c without realizing a lift-off safeguard. In this case, the fixing element 64 then, for example, cooperates with the cut-out 12 or with the recess 20 of the carrier 2. The pivot process described runs in accordance with FIGS. 6a to 6c analog to the pivot process described in connection with FIGS. 5a-c with the difference that the rear side of the base section 4 of the carrier 2 in accordance with FIG. 6c is ultimately supported at the support surface 78 of the abutment lug 70, whereby it is in turn avoided that the fixing element 64 can move out of the recess 20 or 22. It can furthermore be seen from FIG. 6c that the fixing element 64 does not have any first hook element 87 so that the formwork element 98 can be raised perpendicularly upwardly parallel to the base section 4.

Figure 7:
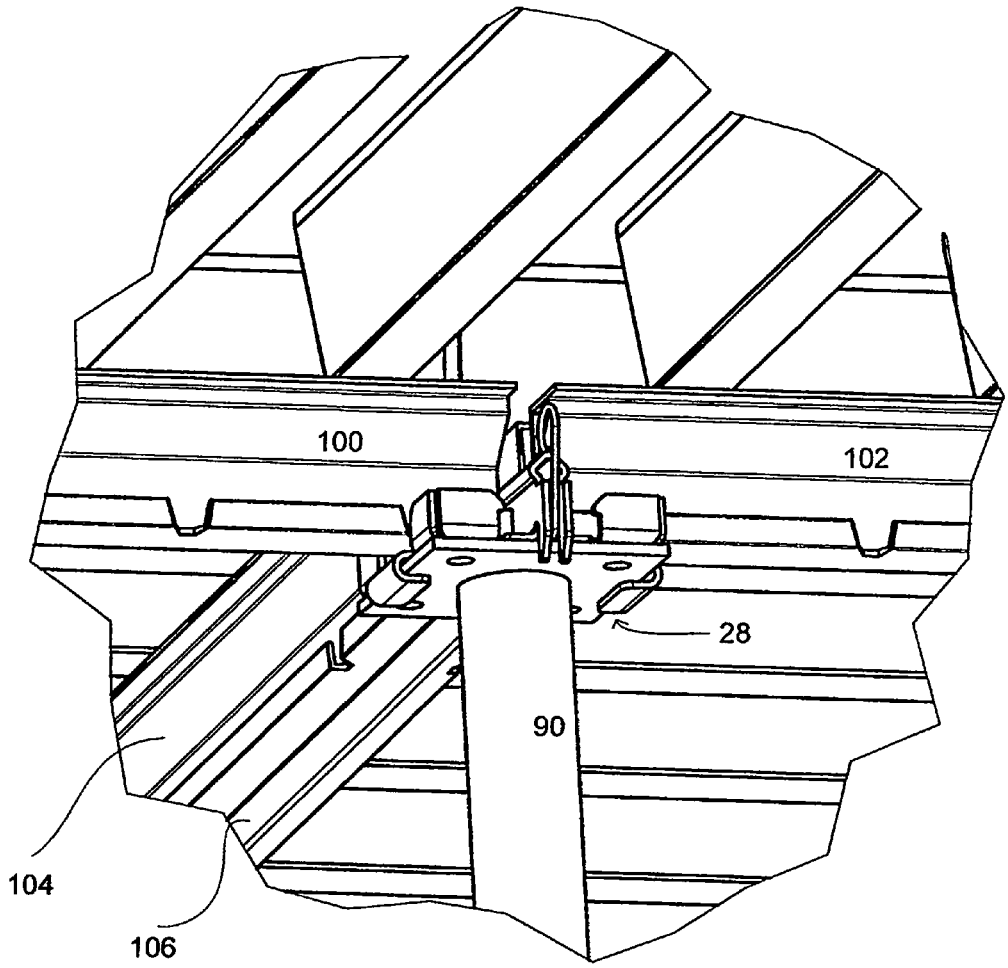
FIG. 7 is a three-dimensional view of a vertical support head coupled with four carriers obliquely from below, with two carriers being aligned perpendicular to two further carriers.

FIG. 7 shows a total of four carriers 100, 102, 104, 106 which are coupled to a head 28 of a vertical support 90. The two carriers 100, 102 are arranged aligned with one another spaced apart from one another at the end face, whereas the two carriers 104, 106 extend parallel to one another and perpendicular to the carriers 100, 102. All carriers 100 to 106 are made in the manner described in connection with the carrier 2 in accordance with FIG. 1. The following fixing elements, recesses and abutment surfaces cooperate here with respect to the different carriers 100 to 106:

carrier 100: fixing element 56, recess 20, abutment surface 74 carrier 102: fixing element 62, recess 20, abutment surface 76 carrier 104: fixing element 52, recess 20, abutment surface 80 carrier 106: fixing element 66, recess 20, abutment surface 86

The carriers 104, 106 are—contrary to the carriers 100, 102—secured against a lifting off due to the cooperation with the fixing elements 52, 66 which each have a first hook element 87.

Figure 8:
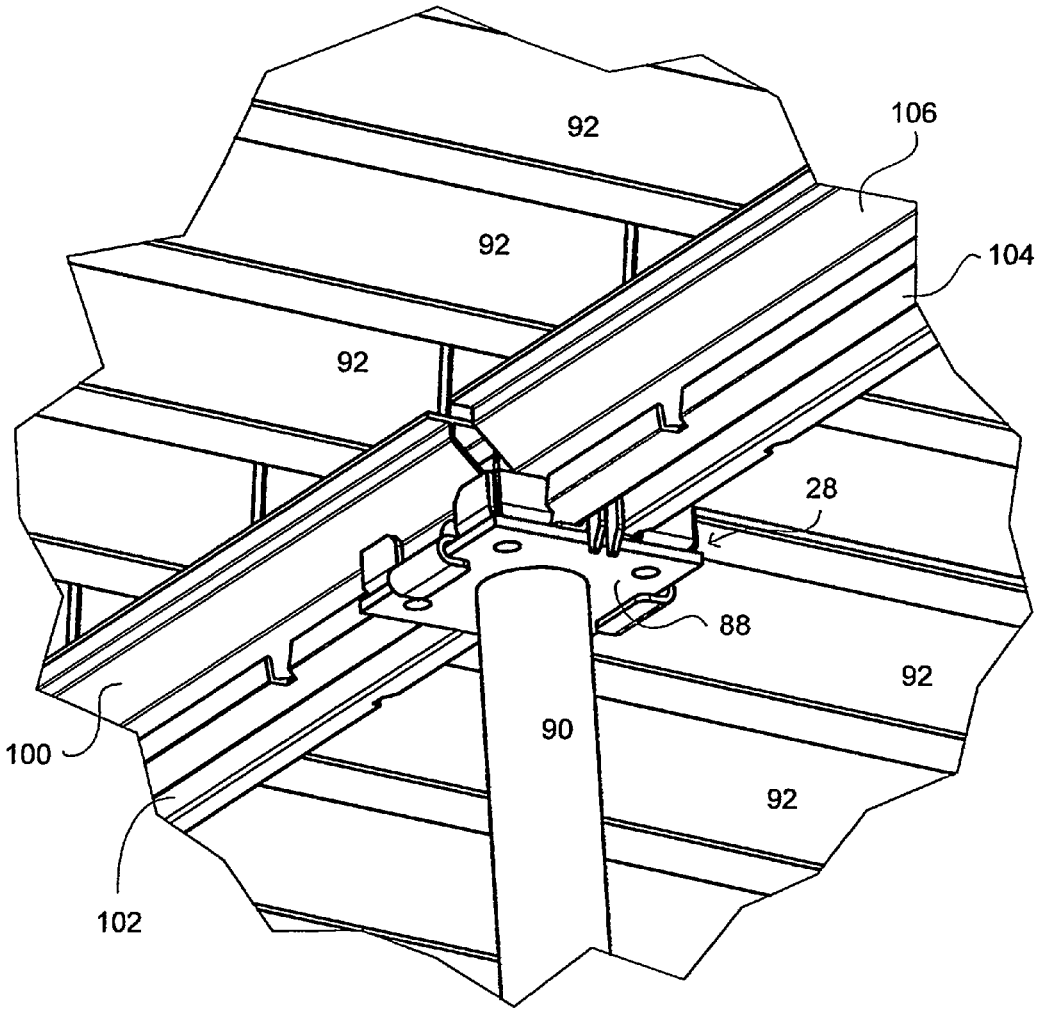
FIG. 8 is a view in accordance with FIG. 7 in which all four carriers extend parallel to one another.

FIG. 8 shows an arrangement in which all the carriers 100 to 106 extend parallel to one another, with in each case two carriers 100 and 106 or 102 and 104 respectively being arranged aligned with one another in the longitudinal direction spaced apart from one another at the end face. In this arrangement, the following fixing elements, recesses and abutment surfaces cooperate:

carrier 100: fixing element 52, recess 20, abutment surface 80 carrier 102: fixing element 66, recess 20, abutment surface 86 carrier 104: fixing element 60, recess 20, abutment surface 84 carrier 106: fixing element 58, recess 20, abutment surface 82

All the carriers 104, 106, 100, 102 are secured against a lifting off due to the cooperation with the fixing elements 52, 58, 60, 66 which each have a first hook element 87.

In accordance with the invention, any other desired arrangements of one to four carriers at one head 28 can also be realized. In each carrier 2 coupled with a head 28 via one of the two outer recesses 20 or 22, two different alignments of the carrier 2 offset to one another by 90° can be realized completely independently of all other carriers 2 coupled to the head 28.

The invention claimed is:

1. A slab formwork system, comprising:

at least one vertical support;

at least one head configured to be attached to the vertical support; and at least one formwork element, comprising at least one carrier at a lower side thereof, wherein the carrier is couplable with the head, wherein the carrier comprises a portion that is in direct engagement with the head when the carrier is coupled to the head, and wherein the portion of the carrier is generally elongate and defines a first longitudinal direction and a second, substantially opposite, longitudinal direction, wherein the head comprises:

a lift-off safeguard configured to fix the carrier in the vertical direction; and one or more fixing elements configured to prevent any longitudinal movement of the carrier in either the first or the second longitudinal direction relative to the head when the carrier is coupled to the head.

2. A slab formwork system in accordance with claim 1, wherein the lift-off safeguard comprises a first hook element, and the carrier comprises a second hook element, wherein the first hook element is configured to engage into the second hook element.

3. A slab formwork system in accordance with claim 2, wherein at least a regional cross-section of the carrier comprises a C shape with two limbs extending away from a base section, wherein one of the limbs comprises a second hook element.

4. A slab formwork system in accordance with claim 3, wherein the one of the limbs defines a support surface configured to support the carrier on the head.

5. A slab formwork system in accordance with claim 4, wherein the support surface comprises one or more recesses at a lateral end of the support surface remote from the base section of the carrier, and wherein each of the fixing elements of the head is configured to engage into a respective one of the recesses.

6. A slab formwork system in accordance with claim 5, wherein the first hook element is disposed on the fixing element.

7. A slab formwork system in accordance with claim 1, wherein the carrier is couplable to the vertical support selectively in two directions offset by 90° with respect to one another.

8. A slab formwork system in accordance with claim 1, wherein the carrier comprises an open section.

9. A slab formwork system in accordance with claim 5, wherein the recess comprises at least two recesses in each of two longitudinal end regions of the carrier.

10. A slab formwork system in accordance with claim 5, comprising at least two recesses and at least two fixing elements, spaced apart from one another, such that a simultaneous engagement of each of the fixing elements into a respective one of the recesses is possible.

11. A slab formwork system in accordance with claim 5, wherein the support surface comprises, at the end of the support surface, an upwardly extending or angled lug comprising a cut-out of V shape, which is aligned with the recess such that the cut-out and the recess merge into one another.

12. A slab formwork system in accordance with claim 11, comprising at least two cut-outs at longitudinal end regions of the carrier, and at least two corresponding recesses in the support surface.

13. A slab formwork system in accordance with claim 4, wherein a lower side of the support surface extends from the base section at an acute angle.

14. A slab formwork system in accordance with claim 1, wherein the head further comprises a support plane extending substantially perpendicular to a longitudinal direction of the vertical support and at least one fixing lug, angled from the support plane, associated with each fixing element.

15. A slab formwork system in accordance with claim 14, wherein the head comprises eight fixing lugs.

16. A slab formwork system in accordance with claim 14, wherein the support surface is substantially rectangular and comprises two substantially perpendicular fixing lugs in each corner thereof.

17. A slab formwork system in accordance with claim 16, wherein the fixing elements define the lift-off safeguard thereon, and are disposed on first ones of the fixing lugs, and wherein second ones of the fixing lugs do not define the lift-off safeguard.

18. A slab formwork system in accordance with claim 17, wherein the ones of the fixing lugs which extend in a first direction have fixing elements defining the lift-off safeguard disposed thereon; and the ones of the fixing lugs which extend perpendicular to the first direction are free of the lift-off safeguard.

19. A slab formwork system in accordance with claim 3, wherein the head further comprises an abutment region configured to abut a rear side of the base section of the carrier remote from the limbs.

20. A slab formwork system in accordance with claim 19, comprising a total of eight abutment regions each comprising an abutment surface which extends at an angle of approximately 90° to an associated one of the fixing lugs.

21. A slab formwork system in accordance with claim 19, wherein the abutment region comprises four abutment regions defined by a U-shaped protrusion of the support head.

22. A slab formwork system in accordance with claim 14, further comprising two abutment regions defined by an abutment lug projecting out of the support plane.

23. A slab formwork system in accordance with claim 1, wherein the head is connected releasably or fixedly to the vertical support.

24. A slab formwork system in accordance with claim 1, wherein the vertical support comprises a substantially square head plate and the head is configured to be attached to the head plate.

25. A slab formwork system in accordance with claim 24, wherein the head is configured to be pushed onto the head plate in a direction substantially parallel to the head plate.

26. A slab formwork system in accordance with claim 24, wherein a lower side of a support plane of the head is configured to lie directly on the head plate of the vertical support in the installed position.

27. A slab formwork system in accordance with claim 1, further comprising a spring member held in the head, wherein the head can be fixed to the vertical support by the spring member.

28. A slab formwork system in accordance with claim 1, wherein the vertical support and the carrier are configured to be hooked to one another, at an acute angle, with subsequent pivoting of the formwork element while maintaining the hook connection into substantially perpendicular engagement.

29. A slab formwork system in accordance with claim 28, wherein the carrier is configured to be hooked to the head in such a position in which the formwork element extends substantially parallel to the vertical support.

30. A slab formwork system in accordance with claim 1, wherein the formwork element comprises longitudinal members extending spaced apart, and substantially parallel to one another, which are fixedly connected to at least one cross member extending perpendicular thereto, with upper sides of the longitudinal members forming a contact surface for a sheathing, an upper side of the cross member contacting a lower side of the longitudinal members, and a lower side of the cross member forming a support surface to support the carrier on the head.

31. A slab formwork system in accordance with claim 1, wherein the carrier has an upper side which forms a contact surface for a sheathing.

* * * * *